US012006772B1

(12) United States Patent
Al-Dossary et al.

(10) Patent No.: US 12,006,772 B1
(45) Date of Patent: Jun. 11, 2024

(54) METHOD AND APPARATUS OF DRILL BIT ADJUSTABLE GAUGE SYSTEM

(71) Applicant: SAUDI ARABIAN OIL COMPANY, Dhahran (SA)

(72) Inventors: Abdullah Mohammed Al-Dossary, Dhahran (SA); Mohammed Yousef Al-Othman, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/185,803

(22) Filed: Mar. 17, 2023

(51) Int. Cl.
*E21B 10/42* (2006.01)

(52) U.S. Cl.
CPC ..... *E21B 10/42* (2013.01)

(58) Field of Classification Search
CPC ..... E21B 10/42; E21B 10/62; E21B 10/627; E21B 10/633
See application file for complete search history.

(56) References Cited

U.S. PATENT DOCUMENTS 3,163,245 A * 12/1964 York ..... E21B 10/633 175/391
3,982,596 A * 9/1976 Vetter ..... E21B 10/04 175/215
9,708,859 B2 7/2017 Jain et al.
2006/0006003 A1 1/2006 Singh et al.
2007/0251732 A1* 11/2007 Mirchandani ..... E21B 10/633 175/434
2016/0258031 A1* 9/2016 Voglewede ..... C21D 1/18
2020/0277822 A1* 9/2020 Graham ..... E21B 7/28
2021/0025243 A1* 1/2021 Graham ..... E21B 10/633
2021/0095526 A1 4/2021 Chanpura et al.

FOREIGN PATENT DOCUMENTS

EP 2 942 474 A1 11/2015

OTHER PUBLICATIONS

Stroud, Daryl et al., "Gauge Extension Optimizes Conventional Drill Bits for Superior Performance with Rotary Steerable Systems"; Proceedings of the SPE Annual Technical Conference and Exhibition; Paper No. SPE-143193-MS; pp. 1-14; Oct. 30, 2011 (14 pages).

* cited by examiner

*Primary Examiner* — Shane Bomar
(74) *Attorney, Agent, or Firm* — Osha Bergman Watanabe & Burton LLP

(57) ABSTRACT

A drilling tool for drilling a wellbore in a formation includes a drill bit including a plurality of blades and a machined connection disposed on the drill bit. Each of the plurality of blades includes a gauge having a length and an angle. The machined connection is configured to allow attachment of a plurality of machined rings to the plurality of blades. The plurality of machined rings are configured to form the length and the angle of each gauge based on number and type of each machined ring attached. The drill bit is configured to operate in different formations based on the gauge of each of the plurality of blades. The drilling tool is redesigned by removal or addition of one or more of the machined rings based at least in part on a modified length and a modified angle configured in view of a characteristic of the wellbore.

14 Claims, 5 Drawing Sheets

METHOD AND APPARATUS OF DRILL BIT ADJUSTABLE GAUGE SYSTEM

BACKGROUND

The disclosure relates generally to drilling of holes from the surface of the earth to subterranean reservoirs. Fluid is typically produced from a reservoir in a subterranean formation by drilling a wellbore into the subterranean formation, establishing a flow path between the reservoir and the wellbore, and conveying the fluids from the reservoir to the surface through the wellbore. Fluids produced from a hydrogen reservoir may include natural gas, oil, and water. Currently, multiple drill bit designs may be required to drill wells based on drilling application and tools. Drilling a wellbore may require multiple drill bit designs to drill vertical, horizontal, and lateral wells.

Accordingly, there exists a need for preventing multiple designs of a drill bit for one application. A drill bit with an adjustable gauge system may be utilized in any drilling application based on the drilling requirements.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a drilling tool for drilling a wellbore in a formation, comprising: a drill bit comprising a plurality of blades, wherein each of the plurality of blades comprises a gauge having a length and an angle; a machined connection disposed on the drill bit, wherein the machined connection is configured to allow attachment of a plurality of machined rings to the plurality of blades, wherein the plurality of machined rings are configured to form the length and the angle of each gauge based on number and type of each machined ring attached, wherein the drill bit is configured to operate in different formations based on the gauge of each of the plurality of blades, and wherein the drilling tool is redesigned by removal or addition of one or more of the plurality of machined rings based at least in part on a modified length and a modified angle configured in view of a characteristic of the wellbore.

In one aspect, embodiments disclosed herein relate to a method for designing a drilling tool for a wellbore, comprising: selecting a drill bit design based at least in part on an operational need; forming the drilling tool based at least in part on the selection of drill bit design, wherein the drilling tool comprises: a drill bit comprising a plurality of blades, wherein each of the plurality of blades comprises a gauge having a length and an angle; a machined connection disposed on the drill bit, wherein the machined connection is configured to allow attachment of a plurality of machined rings to the plurality of blades, wherein the plurality of machined rings are configured to form the length and the angle of each gauge based on number and type of each machined ring attached, and wherein the drill bit is configured to operate in different formations based on the gauge of each of the plurality of blades; selecting the length of each gauge based on a characteristic of the wellbore; selecting the angle of each gauge based on the characteristic of the wellbore; attaching each of the plurality of machined rings based at least in part on the selection of the length and the selection of the angle; selecting a modified length of each gauge based on the characteristic of the wellbore; selecting a modified angle of each gauge based on the characteristic of the wellbore; and redesigning the drilling tool by removal or addition of one or more of the plurality of machined rings based at least in part on the modified length and the modified angle.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to an adjustable gauge system for a drill bit.

Figure 1:
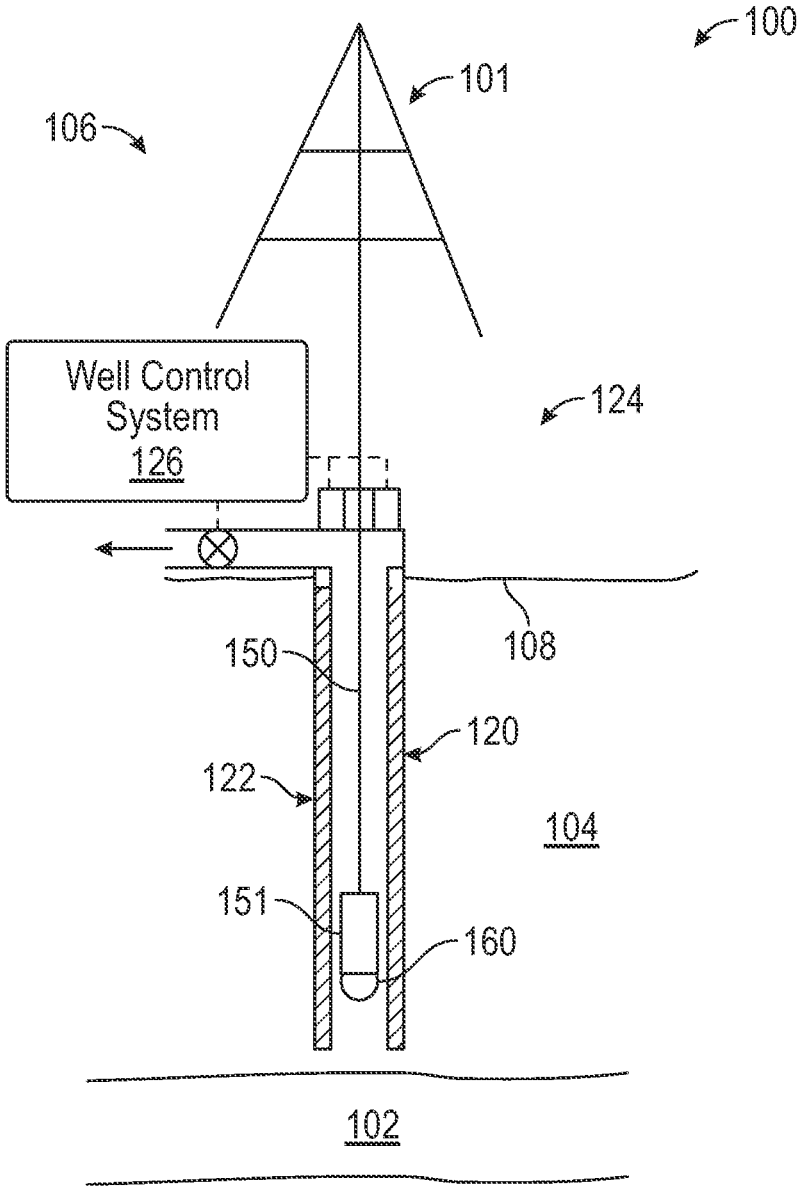
FIG. 1 shows a system in accordance with one or more embodiments.

FIG. 1 shows a schematic diagram in accordance with one or more embodiments. As shown in FIG. 1, a well environment (100) includes a subterranean formation ("formation") (104) and a well system (106). The formation (104) may include a porous or fractured rock formation that resides underground, beneath the surface of the earth or beneath a seabed ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102) (hereafter "reservoir"). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a well subsurface system (122), a well surface system (124), and a well control system (126). The well control system (126) may control various operations of the well system (106), such as well production operations, well drilling operations, well completion operations, well maintenance operations, and reservoir monitoring, assessment, and development operations.

The rig (101) is the machine used to drill a borehole to form the wellbore (120) by rotating a drill bit (160). The drill bit (160) may be referred to as "bit". The wellbore (120) may be vertical, inclined, and/or horizontal. Major components of the rig (101) include the drilling fluid tanks, the drilling fluid pumps (e.g., rig mixing pumps), the derrick or mast, the draw works, the drill string (150), the power generation equipment and auxiliary equipment. A key component of the rig (101) may include a well component (134) for providing rotation and torque to the drill bit (160). A few key advantages to rotating the drill string (150) may include reduced drag, improved hole cleaning, and faster drilling. The well component (134) may be on surface (108) or downhole. The well component (134) on surface (108) may be a rotary table or top drive. The rig (101) may be replaced with a Coiled Tubing Unit and require drilling fluid and mud motors/turbines as the well component (134) to generate rotation for the drill bit (160).

Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit (160) cool and clean during drilling, carrying out drill cuttings, and suspending the drill cuttings while drilling is paused and when the drilling assembly is brought in and out of the borehole. Drilling mud may be a source for power generation in downhole tools, such as motors. The drilling mud may be used to drive downhole motors or turbines to provide extra rotation per minute (RPM) to the drill bit (160). The drilling mud may be used for directional control enabling the wellbore (120) to be steered in a particular direction.

The wellbore (120) includes the borehole that extends from the surface (108) towards a target zone of the formation (104), such as the reservoir (102). An upper end of the wellbore (120), terminating at or near the surface (108), may be referred to as the "uphole" end of the wellbore (120), and a lower end of the wellbore, terminating in the formation (104), may be referred to as the "downhole" end of the wellbore (120). The wellbore (120) may facilitate the circulation of the drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the formation (104) or the reservoir (102) during injection operations, or facilitate the communication of monitoring devices (e.g., logging tools) lowered into the formation (104) or the reservoir (102) during monitoring operations (e.g., during in situ logging operations).

In one or more embodiments, the drill bit (160) may be used to crush or cut rock. The rock may be the formation (104). Elements on the rig (101) directly or indirectly assist the drill bit (160) in crushing or cutting the formation (104). The drill bit (160) may have a rotational motion to cut the formation (104).

Figure 2:
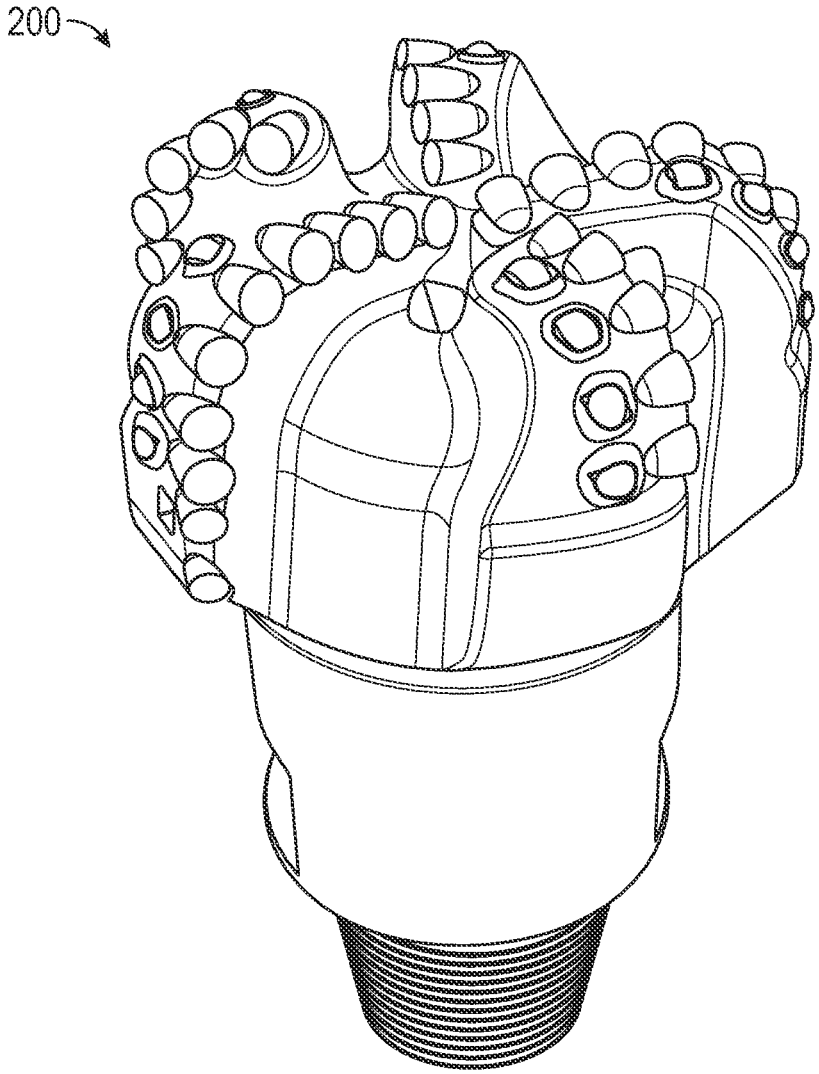
FIG. 2 shows an example of a drill bit in accordance with one or more embodiments.

FIG. 2 shows an example drill bit (160) design. Specifically, FIG. 2 shows a Polycrystalline Diamond Compact (PDC) drill bit (200). The PDC drill bit (200) may be used to drill an extensive array of formations (104) at various depths.

Figure 3:
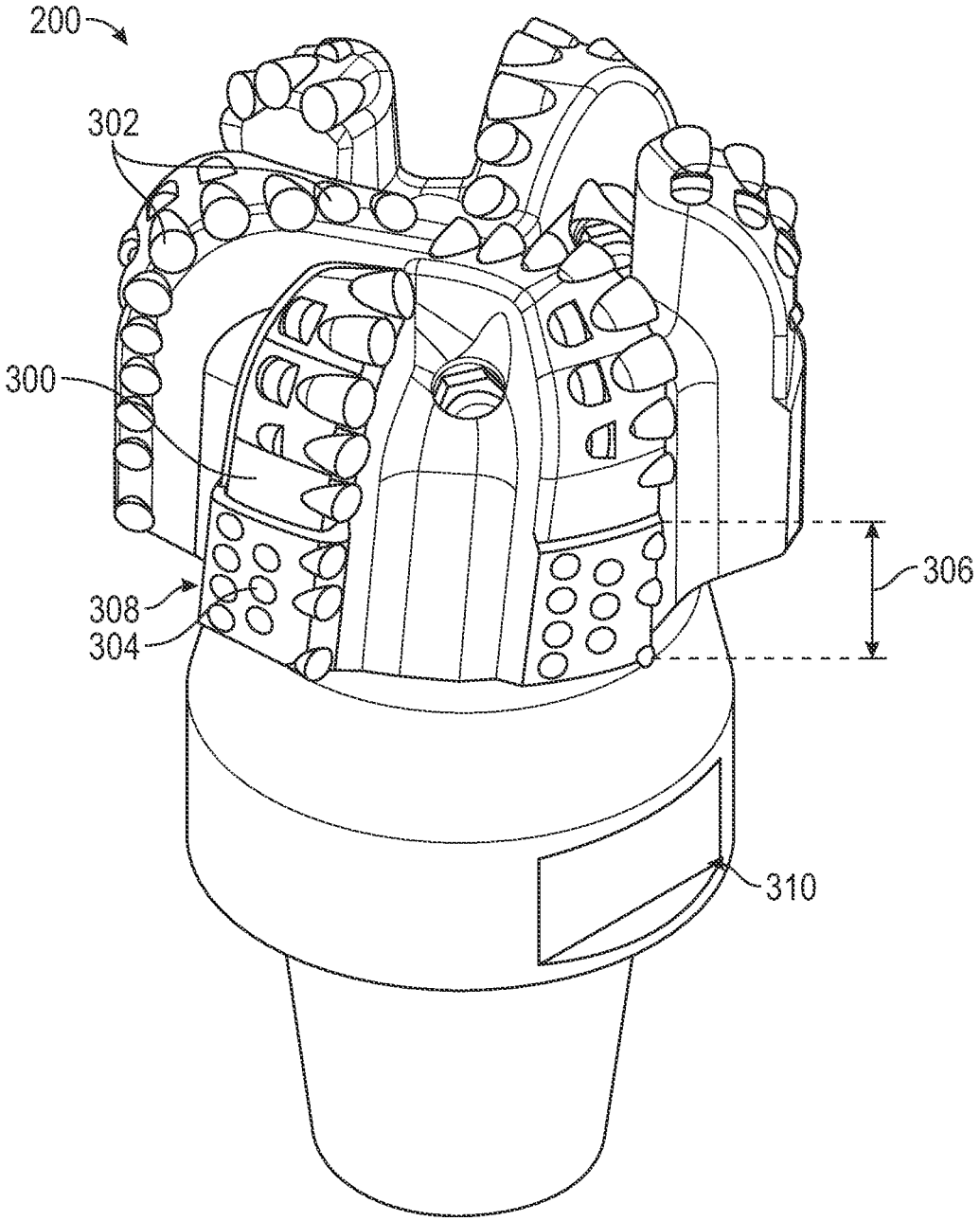
FIG. 3 shows a device in accordance with one or more embodiments.

FIG. 3 shows a device in accordance with one or more embodiments. FIG. 3 shows a PDC drill bit (200). The PDC drill bit (200) may include a blade (300) and cutting teeth (302). The blade (300) may include a gauge (304). The gauge (304) may include a gauge length (306) and gauge angle (308). The gauge angle (308) may be a gauge tilt angle. The gauge length (306) and gauge angle (308) may impact the steerability, build up capability, and aggressiveness of the drill bit (160). The gauge (304) may be the area of the drill bit (160) from the end of the cutting teeth (302) to the shank (310) as illustrated in FIG. 3. The shank (310) is a medium that connects the body of the drill bit (160) with the upper connection of the drill bit (160). The shank (310) may include a taper factor to eliminate sudden changes in diameter. The gauge (304) is an extension of the blades (300). The gauge (304) may facilitate wellbore (120) steering. The gauge (304) may aide in maintaining wellbore (120) stability. A person of ordinary skill in the art may appreciate different drill bit (160) characteristics of gauge length (306) and gauge angle (308) may be suitable for vertical, deviated, or horizontal applications. The cutting teeth (302) may aide in cutting the rock in the formation (104).

The gauge length (306) and gauge angle (308) may define the compatibility of the drill bit (160) with different drive systems, such as rotary steerable systems. The RSS may be responsible for steering the drill bit (160) with continuous rotation. The RSS may have different working principles that require a specific type of gauge length (306) or gauge angle (308) for performance in building and steerability capability. The RSS may be a push the drill bit (160) system or point the drill bit (160) system. The type of RSS may require different gauge lengths (306) and gauge angles (308) to delivery optimal performance. A drill bit (160) design may be selected to accommodate the RSS gauge length (306) and gauge angle (308) requirements.

Figure 4:
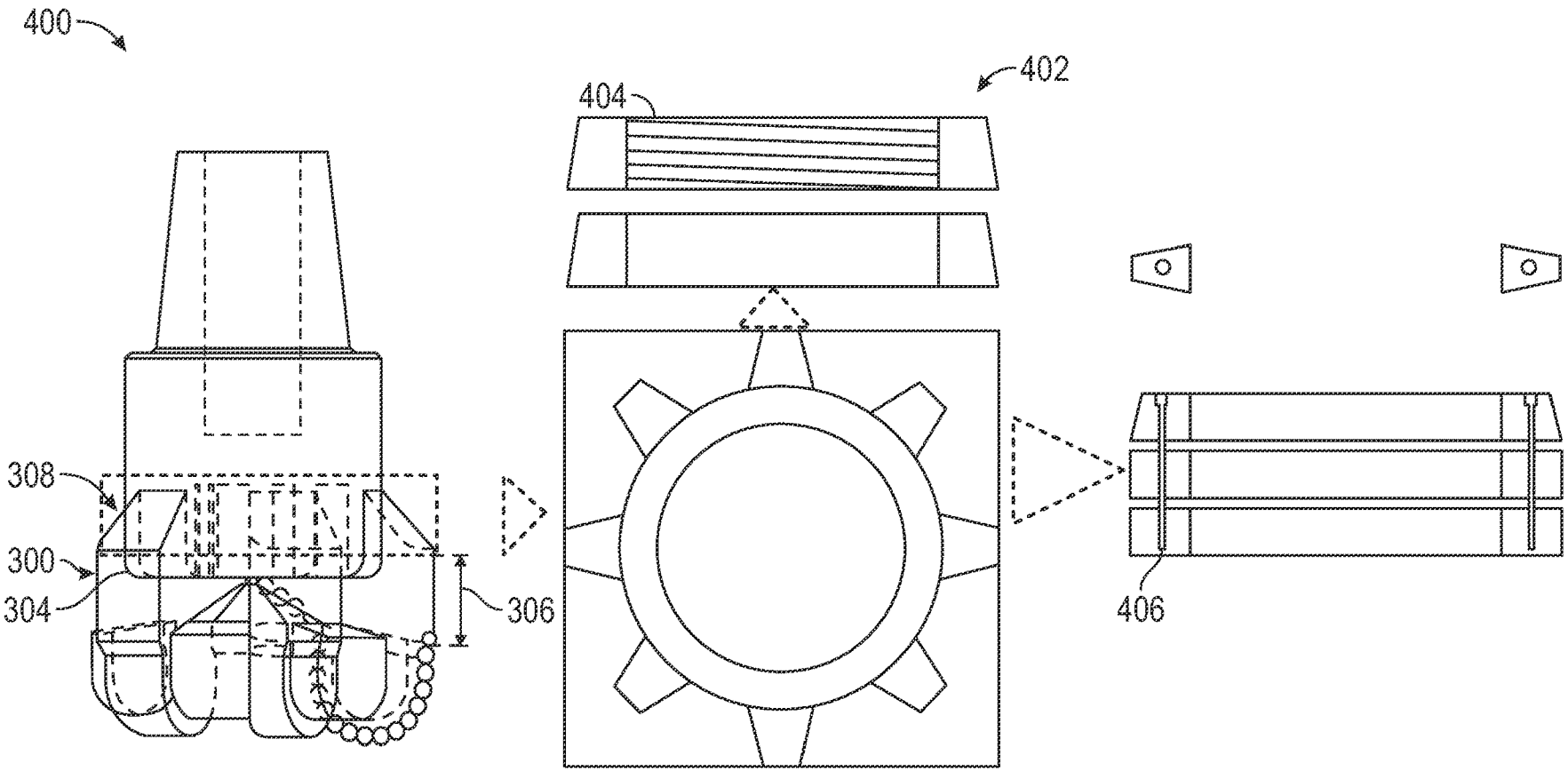
FIG. 4 shows a device in accordance with one or more embodiments.

FIG. 4 shows a device in accordance with one or more embodiments. FIG. 4 shows a drilling tool (400) for drilling the wellbore (120) in the formation (104). The drilling tool (400) may have a drill bit (160) with a machined connection (402). The drill bit (160) may have a plurality of blades (300). The blades (300) may have a gauge (304) with a length (306) and an angle (308). The drill bit (160) may operate in different formations (104) based on the gauge (304) of each blade (300). The machined connection (402) may be on the drill bit (160). The machined connection (402) is configured to allow attachment of a plurality of machined rings (404) to the blades (300).

The machined rings (404) may be made up of a wide variety of material selected in view of the drilling environment within the wellbore (120). The machined rings (404) may be of a material in similar composition to the drill bit (160). The machined rings (404) may be of a size dependent on a planned gauge angle (308). The machined rings (404) are configured to form the length (306) and angle (308) of each gauge (304) based on number and type of each machined ring (404) attached. The machined rings (404) and machined connection (402) may be attached to the drill bit (160) via threads. The threads may connect the machined rings (404) and machined connection (402) horizontally into the drill bit (160). The drilling tool (400) may be redesigned by removal or addition of one or more of the machined rings (404). The redesign may be based at least in part on a modified length and a modified angle of the gauge (304) configured in view of a characteristic of the wellbore (120). The characteristic of the wellbore (120) may be based at least in part on formation (104) depth. The characteristic of the wellbore (120) may be based at least in part on formation (104) hardness. The characteristic of the wellbore (120) may be based at least in part on the RSS employed.

Furthermore, the drilling tool (400) may include a locking pin (406) configured to secure the machined rings (404) to the blades (300). The locking pin (406) may be an additional means for securing the rings (404) in place vertically. The locking pin (406) may be used in an area where the machined ring (404) forms the blade (300).

The drilling tool (400) may allow customization of the gauge (304) on site of the rig (101). The machined rings (404) may be provided with the drilling tool (400) to have flexibility to change the gauge (304) in case of any modification required. The modification may be a last-minute application change. The robust, mechanical, and cost-effective technique of the drilling tool (400) may eliminate the need to buy or rent different drill bits (160) for each specific drilling application. The drilling tool (400) may prevent the need to order a new design for a drill bit (160).

The drilling tool (400) may provide a cost-effective repairing solution for damaged drill bits (160). The drilling tool (400) may prevent a complete drill bit (160) replacement if damage to the gauge (304) is present. The drilling tool (400) may provide a versatile drill bit (160) that can be modified on location to adhere to operation needs. The drilling tool (400) may be utilized for any type of drilling orientation. The drilling tool (400) may eliminate the large inventory of drill bits (160) owned or rented. The drilling tool (400) may provide an environmental impact by reducing material usage and waste required to manufacture numerous drill bits (160) for different drilling applications by replacing the drill bits (160) with one drilling tool (400). The drilling tool (400) may diversify supplier selection through eliminating the limitation of the users own gauge (304) technology.

Figure 5:
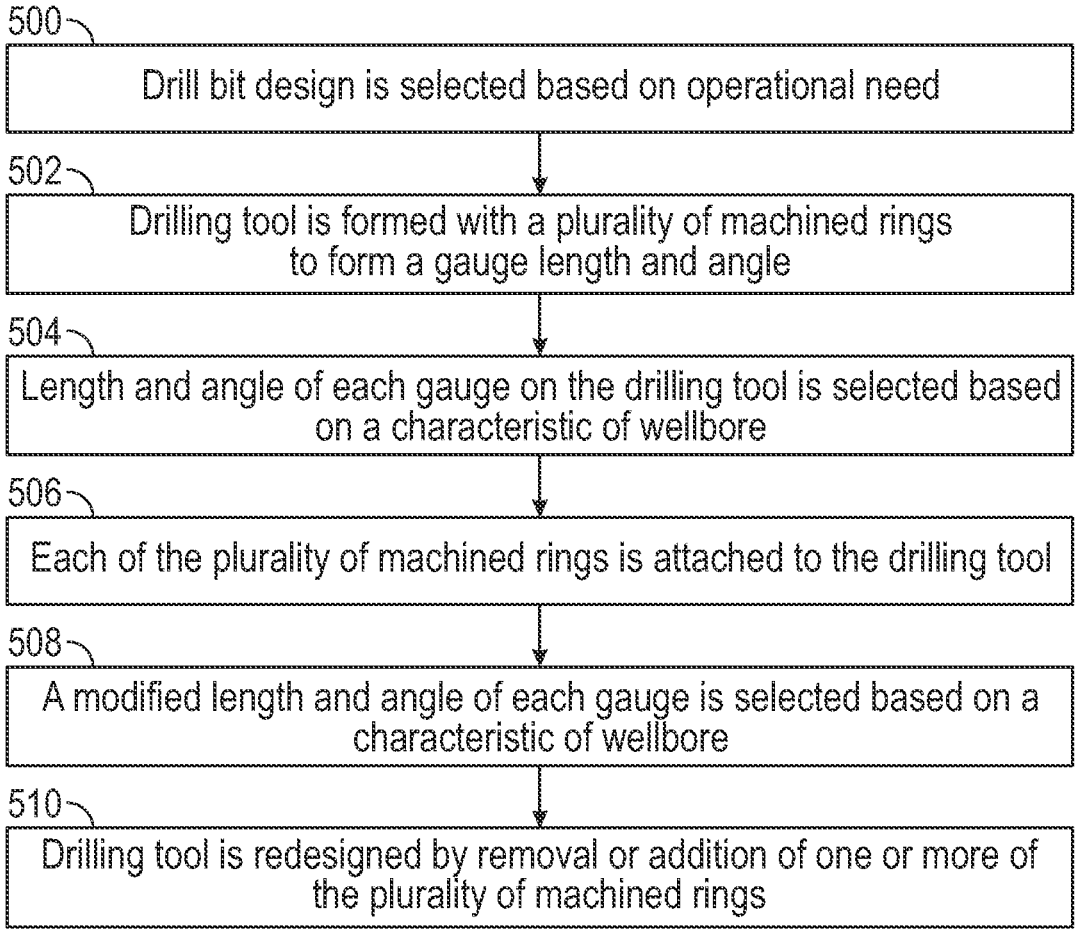
FIG. 5 shows a flowchart in accordance with one or more embodiments.

FIG. 5 shows a flowchart in accordance with one or more embodiments. Specifically, FIG. 5 shows a method for designing the drilling tool (400) for the wellbore (120). One or more blocks in FIG. 5 may be performed using one or more components as described in FIGS. 1 through 4. While the various blocks in FIG. 5 are presented and described sequentially, one of ordinary skill in the art will appreciate that some or all of the blocks may be executed in parallel and/or iteratively. Furthermore, the blocks may be performed actively or passively.

In Block 500, a drill bit (160) design is selected based on an operational need. The operational need may be based at least in part on a formation (104) depth. The operational need may be based at least in part on formation (104) hardness. The drill bit (160) may be a fixed-cutter bit (200). In Block 502, the drilling tool (400) is formed with a plurality of machined rings (404) to form gauge length (306) and gauge angle (308). The drilling tool (400) may be formed based at least in part on the selection of drill bit (160). The drilling tool (400) may include a plurality of blades (300). The blades (300) may include a gauge (304). The gauge (304) may include the gauge length (306) and gauge angle (308). A machined connection (402) may be disposed on the drill bit (160). The machined connection (402) may be configured to allow attachment of the machined rings (404) to the blades (300). The machined rings (404) may be configured to form the gauge length (306) and the gauge angle (308) based on number and type of each machined ring (404) attached. The machined rings (404) may be selected to cover the gauge length (306) and gauge angle (308). The drill bit (160) may operate in different formations based on the gauge (304) of each blade (300).

In Block 504, the gauge length (306) and gauge angle (308) of each gauge (304) on the drilling tool (400) is selected based on a characteristic of the wellbore (120). The characteristic of the wellbore (120) may be based on but not limited to the RSS employed, formation (104) depth, and/or formation (104) hardness. In Block 506, each of the machined rings (404) are attached to the drilling tool (400). Attaching the machined rings (404) may be based on the selection of the gauge length (306) and gauge angle (308). The machined rings (404) may be secured to the blades (300) via a locking pin (406). In Block 508, a modified length and angle of each gauge (304) is selected based on the characteristic of the wellbore (120). The modified length may be the gauge length (306). The modified angle may be the gauge angle (308). In Block 510, the drilling tool (400) is redesigned by removal or addition of one or more of the machined rings (404). The redesign may be based on the modified length and modified angle. The drilling tool (400) may be sent to the rig (101) with extra machined rings (404) for any modification requirements for redesign. The drilling tool (400) may be adjusted to match new drilling requirements via the redesign.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A drilling tool for drilling a wellbore in a formation, comprising:

a drill bit comprising a plurality of blades, wherein each of the plurality of blades comprises a gauge having a length and an angle;

a machined connection disposed on the drill bit, wherein the machined connection is configured to allow attachment of a plurality of machined rings to the plurality of blades, wherein the plurality of machined rings are configured to form the length and the angle of each gauge based on number and type of each machined ring attached, wherein the drill bit is configured to operate in different formations based on the gauge of each of the plurality of blades, and wherein the drilling tool is redesigned by removal or addition of one or more of the plurality of machined rings based at least in part on a modified length and a modified angle configured in view of a characteristic of the wellbore.

2. The drilling tool of claim 1, comprising:

a locking pin configured to secure the plurality of machined rings to the plurality of blades.

3. The drilling tool of claim 1, wherein the drill bit is a fixed-cutter bit.

4. The drilling tool of claim 1, wherein the characteristic of the wellbore is based at least in part on a formation depth.

5. The drilling tool of claim 1, wherein the characteristic of the wellbore is based at least in part on a formation hardness.

6. The drilling tool of claim 1, wherein the characteristic of the wellbore is based at least in part on a rotary steerable system (RSS) employed.

7. A method for designing a drilling tool for a wellbore, comprising:

selecting a drill bit design based at least in part on an operational need;

forming the drilling tool based at least in part on the selection of drill bit design, wherein the drilling tool comprises:

a drill bit comprising a plurality of blades, wherein each of the plurality of blades comprises a gauge having a length and an angle;

a machined connection disposed on the drill bit, wherein the machined connection is configured to allow attachment of a plurality of machined rings to the plurality of blades, wherein the plurality of machined rings are configured to form the length and the angle of each gauge based on number and type of each machined ring attached, and wherein the drill bit is configured to operate in different formations based on the gauge of each of the plurality of blades;

selecting the length of each gauge based on a characteristic of the wellbore;

selecting the angle of each gauge based on the characteristic of the wellbore;

attaching each of the plurality of machined rings based at least in part on the selection of the length and the selection of the angle;

selecting a modified length of each gauge based on the characteristic of the wellbore;

selecting a modified angle of each gauge based on the characteristic of the wellbore; and redesigning the drilling tool by removal or addition of one or more of the plurality of machined rings based at least in part on the modified length and the modified angle.

8. The method of claim 7, wherein designing the drilling tool further comprises:

securing the plurality of machined rings to the plurality of blades via a locking pin.

9. The method of claim 7, wherein the characteristic of the wellbore is based at least in part on a rotary steerable system (RSS) employed.

10. The method of claim 7, wherein the operational need is based at least in part on a formation depth.

11. The method of claim 10, wherein the characteristic of the wellbore is based at least in part on the formation depth.

12. The method of claim 7, wherein the characteristic of the wellbore is based at least in part on a formation hardness.

13. The method of claim 12, wherein the operational need is based at least in part on the formation hardness.

14. The method of claim 7, wherein the drill bit is a fixed-cutter bit.

* * * * *